US006248406B1

(12) United States Patent
Kondo et al.

(10) Patent No.: US 6,248,406 B1
(45) **Date of Patent: *Jun. 19, 2001**

(54) LIGHT-SENSITIVE MATERIAL AND COATING APPARATUS THEREOF

(75) Inventors: Yoshikazu Kondo; Koji Fukazawa; Akira Nishiwaki, all of Hino (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/998,489

(22) Filed: Dec. 26, 1997

(30) Foreign Application Priority Data

Dec. 26, 1996 (JP) ..... 8-347627

(51) Int. Cl.[7] ..... B05D 1/30
(52) U.S. Cl. ..... 427/420; 118/DIG. 4
(58) Field of Search ..... 118/324, 325, 118/410, DIG. 4; 427/420, 402

(56) References Cited

U.S. PATENT DOCUMENTS 4,479,987 10/1984 Koepke et al. .

FOREIGN PATENT DOCUMENTS 0051238 5/1982 (EP) .
0327020 8/1989 (EP) .
0567071 10/1993 (EP) .
567071 * 10/1993 (EP) ..... 427/420
0599740 6/1994 (EP) .

OTHER PUBLICATIONS

European Search Report EP 97 31 0496 Feb. 24, 1999.

* cited by examiner

*Primary Examiner*—Brenda A. Lamb
(74) *Attorney, Agent, or Firm*—Jordan B. Bierman; Bierman, Muserlian and Lucas

(57) ABSTRACT

A coating apparatus for coating a conveyed support with an emulsion for a photographic light-sensitive material by letting the emulsion flow down between a pair of edge guides so as to form a curtain layer of the emulsion. The apparatus includes a slide surface, having a slit and inclined for a predetermined angle to the horizontal axis, for supplying the emulsion; side plates provided on both edges of the slide surface; the pair of edge guides each provided on respective one of the edges; and plural solution injecting outlets, each provided on respective one of the side plates, for supplying auxiliary solution; in which a coating operation of the conveyed support with the emulsion is conducted while the auxiliary solution is being flowed down along the edge guides at a flow rate between 0.3 cc/min. and 3.0 cc/min. from each of the solution injecting outlets.

6 Claims, 7 Drawing Sheets

LIGHT-SENSITIVE MATERIAL AND COATING APPARATUS THEREOF

BACKGROUND OF THE INVENTION

The present invention relates to a coating method generally called free-falling vertical curtain coating, and in particular, to curtain coating used in manufacture of photographic light-sensitive materials.

As a technology to form layers of various types by coating some emulsions on a support (paper, metal, synthetic resin or the like) conveyed continuously, there are given a slide bead coating method, a rod coating method, an extrusion coating method and a curtain coating method. In the method called the curtain coating method among the aforesaid methods, a coating solution flowing out of slits provided on the slide surface flows down uniformly along the slide surface, then, goes down in the state of a curtain formed between edge guides provided on both sides of the lower part on the slide surface to fall on the support so that a coating layer is formed. When comparing with a conventional slide hopper coating method, for example, this curtain coating method can coat thinner layers at higher coating speed, and it is superior to the slide bead coating method in terms of mass production and of energy conservation.

On the other hand, however, there is caused an edge unevenness tendency in the curtain coating method, because "a process to form a coating solution to be curtain-shaped" is newly added. This is a tendency wherein a thickness of an edge portion in the conveyance direction on a layer coated and formed is increased, resulting in uneven layer thickness of a total coating layer. With regard to this point, various studies which have been made up to now show that unevenness of the curtain thickness in the lateral direction is increased as the curtain flows down between edge guides.

In addition, a flow speed of the curtain (coating solution) is especially slow in the vicinity of an edge guide, which sometimes causes destruction of an edge portion on the curtain.

Namely, there is required, for the appropriate curtain coating, a technology to keep the layer thickness constant in the lateral direction while forming the curtain itself stably, For these requirements, there have been suggested technologies disclosed in (1) TOKKAISHO 51-57734 and (2) TOKKAIHEI 4-354563, for example. However, the technology in (1) above has a problem that unevenness in the lateral direction increases, though the curtain itself therein is stabilized. This problem is remarkable especially when a coating solution having low surface tension is used. In the case of the technology in (2) above, an effect is insufficient totally, and in particular, when the flow rate of a coating solution is lowered, unstable and uneven portions on the curtain are increased.

Therefore, there have been suggested technologies relating to the so-called "side solution" wherein a solution which is different from the coating solution is caused to flow down along the edge guides to support a curtain, such as those disclosed in (3) TOKKAISHO 59-132966, (4) TOKKAIHEI 3-50085, (5) TOKKAIHEI 1-199668 and (6) TOKKAIHEI 5-293429.

Even in these technologies, however, a problem of "unevenness in the lateral direction" has not been solved sufficiently, though they are effective on the point of "forming the curtain stably". When the flow rate of the side solution is great, in particular, mixture of the side solution and the coating solution is caused in the vicinity of the edge guide, resulting in an increase of "unevenness in the lateral direction", which is a problem.

This unevenness of a layer thickness on the edge portion is one shown in FIG. 6, and proposed technologies for letting the side solution flow down as stated above, for absorbing the coating solution on the edge portion after coating, and for improving physical properties of the coating solution, have not yet solved the problem of unevenness of a layer thickness effectively, and these technologies can not cope with high speed coating presently.

SUMMARY OF THE INVENTION

An object of the invention is to form a curtain stably and to solve the problem of the layer thickness unevenness, and thereby to realize highly productive curtain coating which can easily be realized with an extremely simple structure, and can lower the manufacturing cost.

After various studies, the inventors of the invention obtained the following findings, taking into consideration that layer thickness of a coating layer itself is increased when the flow rate of a side solution (auxiliary solution) is increased, though the curtain is stabilized. Namely, the findings show that the minimum quantity of the side solution which is necessary to form a curtain stably exists, and even when the flow rate is increased from this minimum and necessary supply quantity, the state of unevenness on the edge portion remains unchanged if the increase of the flow rate is within a certain range, but when this range is exceeded, unevenness on the edge portion is increased.

Therefore, the inventors of the invention found, after intensive studies, that it is possible to reduce the unevenness on the edge portion by using a side solution and by thinking out, in particular, a flow rate, a position for the solution to start flowing down, and physical properties. In the case of the flow rate, in particular, they found the critical point where it is possible to make the mixture with a coating solution to be minimum and thereby to reduce the unevenness on the edge portion by determining the upper limit and the lower limit. They also found that the effect to overcome the unevenness on the edge portion is greater when the position to start supplying the side solution is on the upper stream side of the curtain, though a range of an amount of the side solution to be supplied is not affected by the position for supplying.

The present invention has been achieved based on the findings mentioned above, and it is structured by the following technical means.

(1) A coating apparatus for coating a conveyed support with a coating solution by letting the coating solution flow down between a pair of edge guides so as to form a curtain layer of the coating solution. The coating apparatus includes a slide surface, having thereon slits for supplying the coating solution and inclined for a prescribed angle to the horizontal axis, side plates, provided on both edges of the slide surface, a pair of edge guides, provided on the edges of the slide surface, and solution injecting means each of which is provided on respective one of the side plates and supplying auxiliary solution from solution injecting outlets being in contact with the slide surface, in which coating is conducted while the auxiliary solution is being flowed down along the edge guides at a flow rate between 0.3 cc/min. and 3.0 cc/min. from each of the solution injecting means on both sides.

Namely, the invention makes it possible to form a curtain stably by supplying an appropriate amount of side solution from a solution injecting outlet, and thereby to form a coating layer having less unevenness on the edge portion, which leads to cost reduction and an increase in yield. Further, reduction of thick layers on the edge portion also reduces a load on a process to dry after coating, which leads to advantages of low cost in the viewpoint of manufacturing facilities.

(2) A coating apparatus wherein the solution injecting outlet is in contact with the slide surface either at the height which is the same as that of the slit for supplying a coating solution, or at the height upper than that of the slit for supplying a coating solution.

Namely, the invention surely reduces unevenness on the edge portion caused by a side solution, because it is possible to increase the flow speed at an edge portion of a coating solution which flows down along the slide surface, by letting the side solution flow down from the solution injecting outlet either at the height which is the same as that of the slit for supplying a coating solution, or at the upstream side.

(3) A coating apparatus wherein a coating solution at a flow rate ranging from 0.5 cc/min. to 10.0 cc/min. is supplied from the slit for supplying a coating solution.

Namely, it has been confirmed that the invention can make the uneven portion to be minimum while maintaining a curtain surely, when the flow rate of the coating solution ranges from 0.5 cc/min. to 10.0 cc/min.

(4) A coating apparatus wherein a coating solution having a viscosity between 10 cp and 100 cp is supplied from the slit for supplying a coating solution.

Namely, in the invention, stable forming of a curtain and an effect to overcome unevenness on the edge portion, in particular, are remarkable, when the viscosity of a coating solution is in a range of 10–100 cp.

(5) A coating apparatus wherein a coating solution supplied from the slit for supplying a coating solution is an emulsion for a photographic light-sensitive material.

Namely, in the invention, it is possible to obtain a photographic light-sensitive material in which a layer thickness is stable, because an emulsion for a photographic light-sensitive material is supplied as a coating solution and it is coated on a support.

(6) A coating apparatus wherein a value of surface tension of the auxiliary solution is greater than or the same as the minimum value of surface tension of the coating solution.

Namely, in the invention, it is possible to restrict the mixture of the auxiliary solution and the coating solution to the minimum.

(7) A coating apparatus wherein the viscosity of the auxiliary solution is smaller than that of the coating solution.

(8) A coating apparatus wherein the auxiliary solution is either a gelatin solution of not more than 3% by weight or water.

Namely, the coating apparatus in (7) and the invention make it possible to form a curtain surely, and to prevent the mixture of the coating solution on the edge portion of a curtain and the side solution.

(9) A photographic light-sensitive material manufactured by the use of coating apparatuses described in Items (1)–(8) stated above.

Namely, the invention makes it possible to obtain a photographic light-sensitive material whose layer thickness is stable.

DETAILED DESCRIPTION OF THE INVENTION

The invention will be explained as follows, referring to concrete examples. In the following examples explained below, a photographic paper is manufactured by coating mainly an emulsion for a photographic light-sensitive material on a support made of paper. However, the invention is not limited to the examples, and when conducting curtain coating on a support conveyed continuously, the invention can be applied widely to manufacture of photographic films, magnetic recording materials such as magnetic tapes, and information recording sheets such as pressure sensitive paper and thermosensitive paper, for example.

Figure 1:
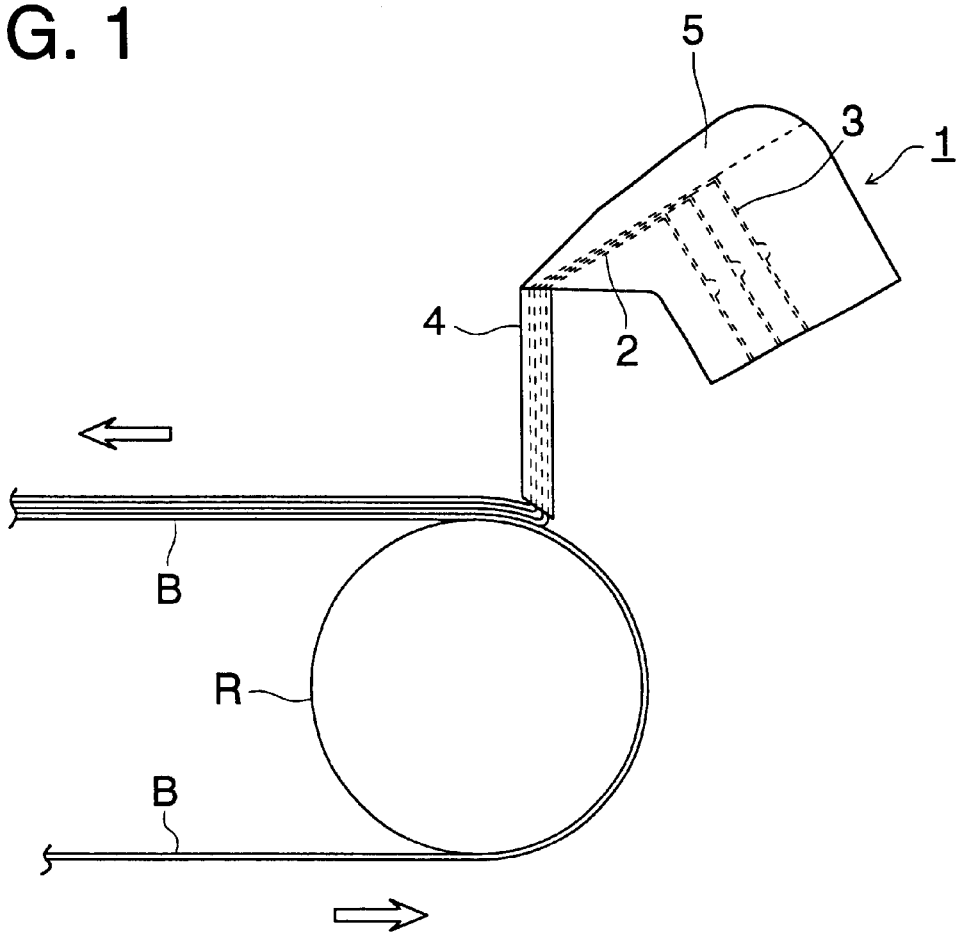
FIG. 1 is a side view of a coating apparatus related to the invention.

What is shown in FIG. 1 is coating apparatus 1 related to the present invention, wherein curtain coating is conducted by backup roller R on support B. Since the coating is conducted by the backup roller R, it does not happen that the coating solution scatters to soil the support on the upstream side in the conveyance direction.

Support B is conveyed by an unillustrated conveyance means. For the support to be conveyed, there are used paper, coated paper, plastic films, films made of resins and metallic thin plates, which can be selected appropriately for obtaining the desired object to be coated. The backup roller R may be either one which comes in contact with a support or one which does not come in contact with a support. When the backup roller R is one which does not come in contact with a support, it is possible to use the so-called air-back-roll wherein a fluid such as air is jetted out of many small holes provided on the roller surface.

The coating apparatus 1 equipped with at least slide surface 2, coating solution supply slit 3, edge guides 4 and 4' and side plates 5 and 5'.

A coating solution is supplied uniformly in the lateral direction from a coating solution supply slit to flow down along the slide surface so that a thin curtain of the coating solution is formed. This thin curtain flows down along the slide surface, then is carried in the shape of a curtain between a pair of edge guides 4 and 4' provided at the lower part of the slide surface, to flow down and to hit the support B so that a coating layer is formed.

It is further possible to provide a prescribed number of slits supplying a coating solution uniformly as occasion demands, and it is possible to laminate coating solutions each being of a thin curtain shape by letting coating solutions flow down from plural slits. FIG. 1 shows a side view of the slide surface on which three slits are provided.

Figure 2:
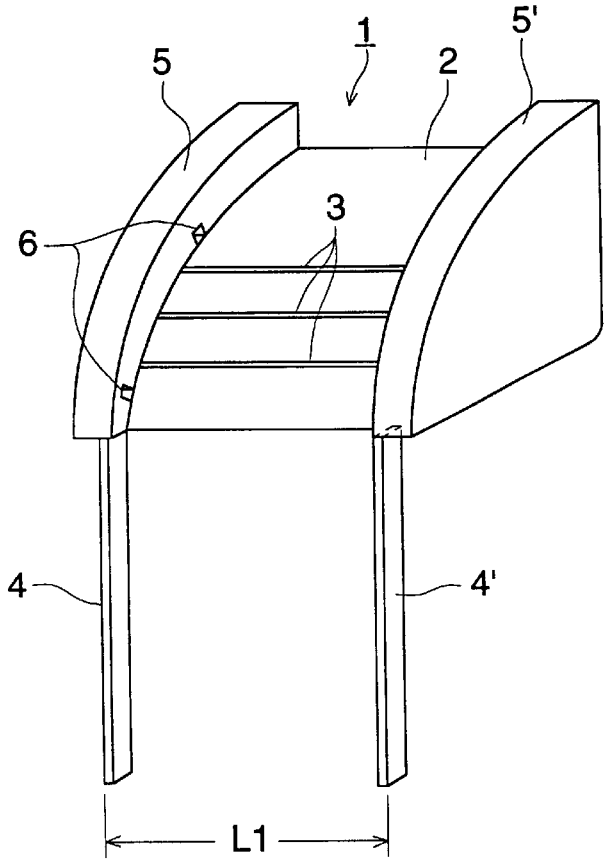
FIG. 2 is a perspective view of a coating apparatus related to the invention.

FIG. 2 shows a perspective view of the slide surface. On edge portions on both sides of the slide surface 2 of coating apparatus 1, there are provided slide plates 5 and 5' by which the coating solution supplied from slit 3 is controlled not to flow down from the side edges of the slide surface. On the side plates 5 and 5', there are provided solution-injecting outlets 6. The solution-injecting outlet 6 is rectangular in shape and its one side is in contact with the slide surface. This solution-injecting outlet 6 is led to an unillustrated solution-injecting mechanism, and it supplies an auxiliary solution (side solution) such as a gelatin solution. When the auxiliary solution is supplied from the solution-injecting outlet 6, the coating solution flowing down along the slide surface flows down to the boundary portion in the vicinity of the side plate, being accompanied by an auxiliary solution, and is transmitted between edge guides through the auxiliary solution, to be coated on the support. From each of the solution-injecting means on both sides, an auxiliary solution in the same quantity is caused to flow down, and its quantity at one side is set to be within a range of 0.3–3 cc/min. Due to this, it is possible to form a curtain stably and to reduce unevenness of curtain thickness in the vicinity of the edge guide.

Further, there is no fear that a side solution is mixed with a coating solution. The size and height of the sectional area of the solution-injecting outlet 6 are appropriately designed and adjusted to the height that comes in contact with all layers of coating solutions flowing down along the slide surface.

It is further preferable that the solution-injecting outlet is located at the position which is either the same as or higher than the coating solution supply slit although the solution-injecting outlet can be located at any portion of the slide surface to obtain a certain level of effect. When a plurality of coating solution supply slits exist, in particular, it is preferable that the position of the solution-injecting outlet is either the same as or higher than the slit which is located to be highest on the slide surface.

A comparison between a coating apparatus related to the invention and a prior art will be shown below.

EXAMPLE 1

Figure 3:
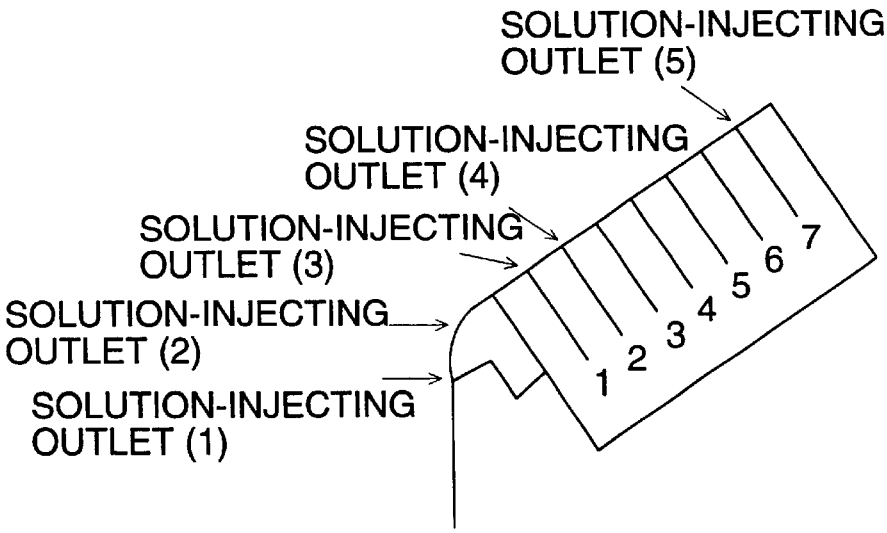
FIG. 3 is a side view of a coating apparatus in an example of the invention.

Multi-layer curtain coating wherein two kinds of coating solutions were superposed on the slide surface was conducted by the use of a coating apparatus whose side view is shown in FIG. 3. When letting a coating solution flow down from the solution-injecting outlet, an auxiliary solution was caused to flow down only from one kind of solution-injecting outlet (a pair at right and left) so that the auxiliary solution may flow down accompanying to both edge portions of the coating solution which flows down along the slide surface. Incidentally, on a lip portion of the coating apparatus in FIG. 3, there is provided solution-injecting outlet (1), and on the intermediate portion between the lip and the slide surface, there is provided solution-injecting outlet (2). Solution-injecting outlets (3) (4) and (5) on the slide surface are provided just beside the coating solution supply slit.

Conditions for the coating solutions are shown in Table 1 below.

TABLE 1

| | Gel % by weight | Viscosity (cp) | Flow rate (cc/min./cm) | | |
|---|---|---|---|---|---|
| Coating solution for first layer | 7.0 | 20.0 | 1.5 | Emulsion layer | Slit 1 |
| Coating solution for second layer | 5.0 | 20.0 | 1.0 | Protective layer | Slit 2 |

A coating solution for the first layer was caused to flow down from Slit 1, and a coating solution for the second layer was caused to flow down from Slit 2. Other coating conditions are as follows.

Coating speed (support conveyance speed) 300 m/min.

Material of support PET

Auxiliary solution is 1% by weight gelatin solution

Curtain height is 10 cm

Figure 6:
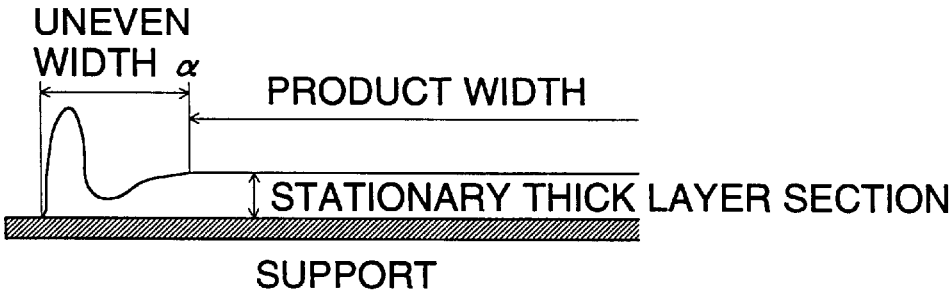
FIG. 6 is a diagram showing unevenness of a layer thickness on the edge portion of a support.

The results were better when a size of uneven width $\alpha$ in FIG. 6 was smaller, and they are shown in Table 2 below.

As is apparent from the results, when an amount of solution flowing down is small in the case of no auxiliary solution flowing down, a width of uneven thickness is extremely large, but when that amount is increased to 0.3 cc/min. or more, the width of uneven thickness is made small, whereby a range capable of being used as a product is broadened, and productivity is improved. However, the width of uneven thickness is increased again when the amount is increased further to 3.0 cc/min. or more.

Figure 7:
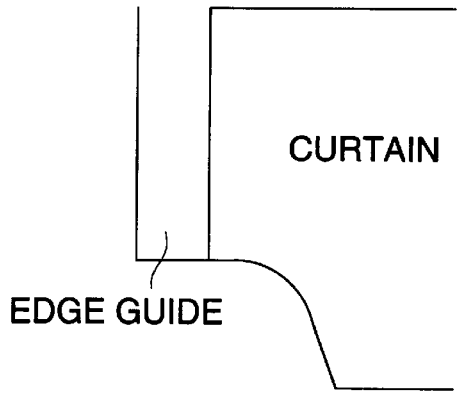
FIGS. 7(A)–7(C) represent a diagram showing an influence of surface tension on a curtain.
Figure 7:
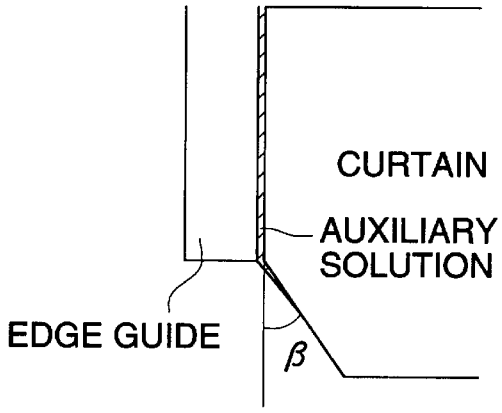
Figure 7:
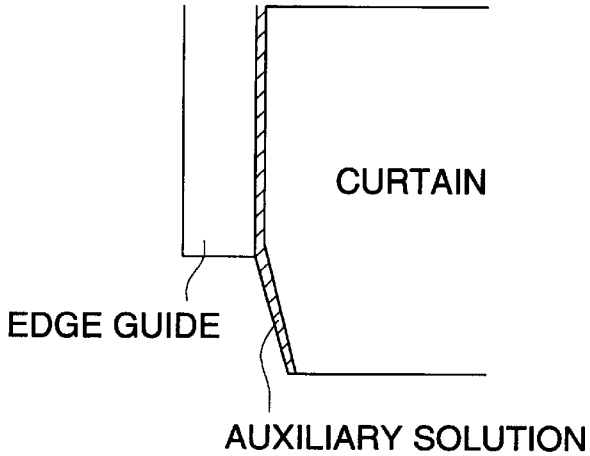

For making this cause clear, follow-up studies were made. When an edge portion on a curtain was observed, a change appeared on the edge portion when an auxiliary solution was caused to flow. Namely, when the auxiliary solution was caused to flow, a thin water column was observed along the edge guide. It was further observed that a coating solution which was away from the edge guide tried to shrink inside itself, being caused by its own surface tension as shown in FIG. 7(A) under the condition of no auxiliary solution, but its force to shrink is made small as shown in FIGS. 7(B) and 7(C) when a side solution (auxiliary solution) is caused to flow. To be concrete, until the moment when the amount of an auxiliary solution is increased up to 3 cc/min., when the flow rate of the auxiliary solution was increased, the force of the curtain to shrink was made smaller gradually, but when the amount of the auxiliary solution exceeded 3 cc/min., the change on the curtain disappeared, simply showing the thickened water column of the auxiliary solution.

Figure 8:
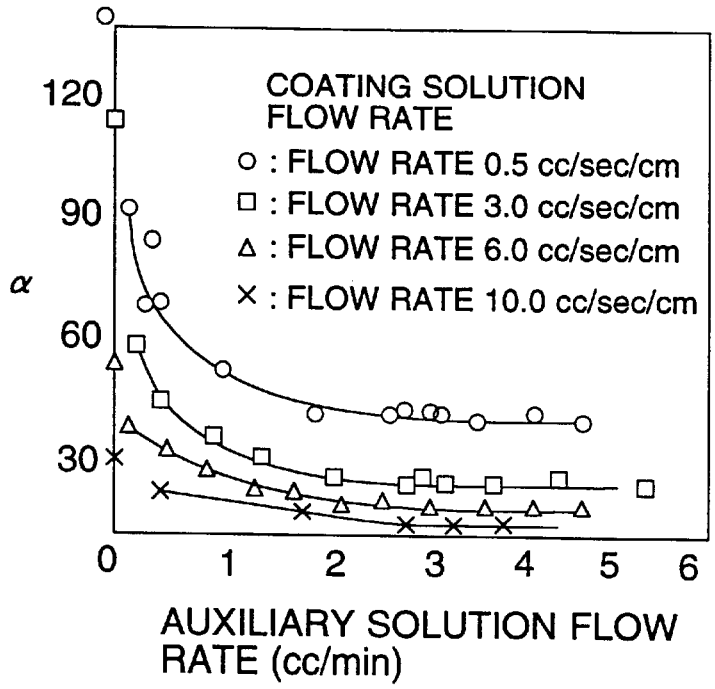
FIG. 8 is a diagram showing the relation between a flow rate of a coating solution and an auxiliary solution and shrink angle $\alpha$ of a curtain.

After angle $\beta$ in FIG. 7(B) at which the curtain shrinks when an auxiliary solution was caused to flow was measured, it was found that the relation between the flow rate of a coating solution and angle $\beta$ represents the relation shown in FIG. 8. It is found that at any flow rate between 0.5 cc/sec/cm and 10 cc/sec/cm, the force of the curtain to try to shrink is made small until the flow rate of the auxiliary solution reaches 3 cc/min. When the occasion wherein an auxiliary solution was not used was observed, separately from the measurement in FIG. 8, the angle $\beta$ grew larger as an amount of the coating solution was made smaller, and formation of the curtain was stopped at the moment of 0.5 cc/sec/cm. It has been confirmed, from the experiments mentioned above, that an inhibiting effect for the force of the curtain to shrink is made smaller as the flow rate of a coating solution is made larger, and the inhibiting effect is caused even in the case of the minimum value of the flow rate of 10 cc/sec/cm.

Figure 10:
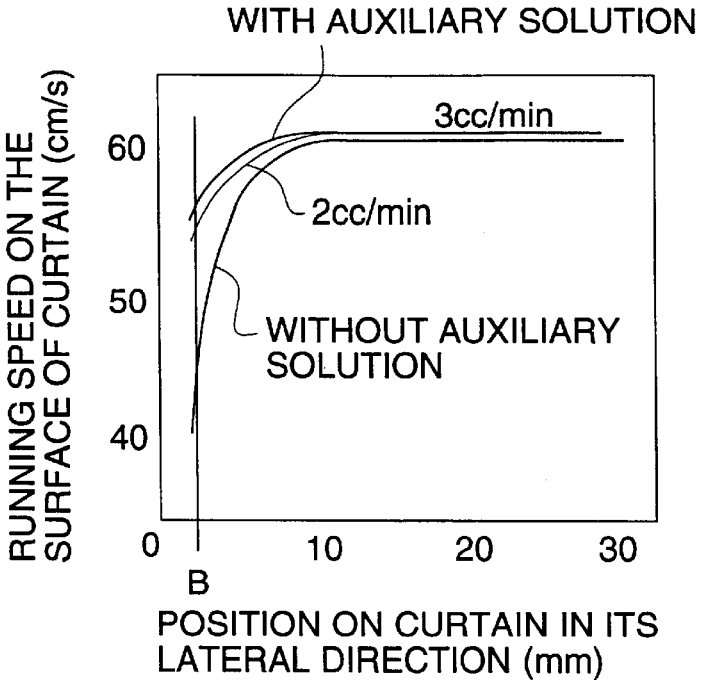
FIG. 10 is a diagram showing the relation between the flow speed on the surface of a curtain and the position in the lateral direction of a curtain.

To make this phenomenon clear, a flow speed on the surface of the curtain was measured through laser Doppler measurement. The laser Doppler measuring instrument made by Mitsubishi Denki Co. was used. Namely, the relation between the flow speed on the surface of the curtain and the position in the lateral direction of the curtain represents relations shown in FIG. 10 for each case of no auxiliary solution, 2 cc/min., and 3 cc/min. Therefore, the relation between the flow speed on the curtain surface and the flow rate of the auxiliary solution was measured at the position B in FIG. 10 which is closer to the edge guide and where the flow speed on the curtain surface is changed most remarkably by increase and decrease of the auxiliary solution. Viscosity of the coating solution in this case was 20 cp, the flow rate of the coating solution was 3 cc/sec/cm and the curtain height where the flow speed was measured was at the position that is 20 mm higher than the tip of the edge guide.

Figure 11:
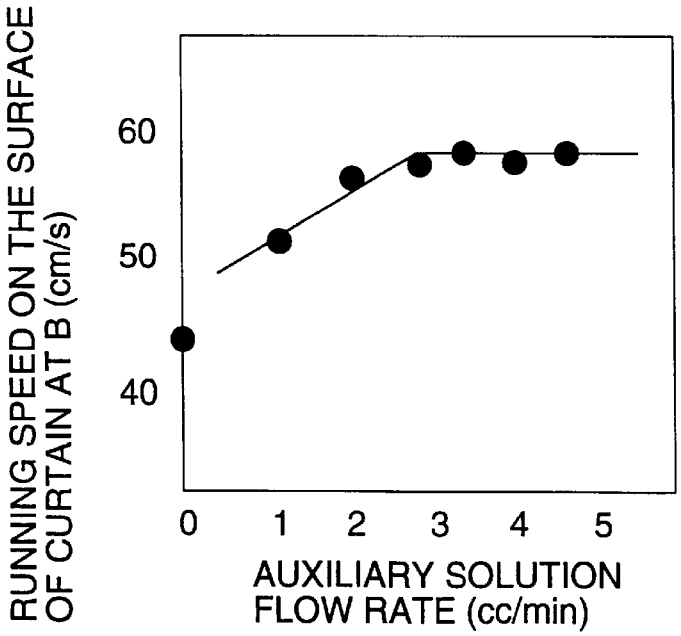
FIG. 11 is a diagram showing the relation between the flow speed on the surface of a curtain and a flow rate of an auxiliary solution.

Due to the foregoing, it was found that the relation between the flow speed on the curtain surface and the flow rate of the auxiliary solution both at the aforesaid measurement position is represented by the relation shown in FIG. 11. Namely, there were made clear two points, one is that the flow speed in the vicinity of the edge portion of the curtain is increased by using an auxiliary solution, and the other is that the flow speed is not changed even if the flow rate of the auxiliary solution is increased to 3 cc/min. or more. Accordingly, an effect of the side solution (auxiliary solution) is to bring the flow speed in the vicinity of the edge portion of the curtain close to the flow speed at the central portion of the curtain, and due to this, it is shown that an inclination of surface tension which is the force to try to shrink caused by flow speed distribution in the lateral direction of the curtain is moderated. Summarizing the foregoing, it was found out that the flow rate of an auxiliary solution for supplementing the curtain measuring up to 3.0 cc/min. is enough. If the flow rate is increased to exceed the aforesaid value, the coating solution and the auxiliary solution are mixed, uneven portions are increased, product portions are reduced, moisture in the edge portion of a coated layer is increased, and defective drying after coating happens. To avoid this problem, it is necessary to introduce facilities. When the auxiliary solution is not used, angle β is in its large state and thereby the curtain is unstable, and even when the curtain is formed, the force of the solution to try to shrink is great. Therefore, an uneven thickness portion of the coated solution is great, reducing product portions to lower the yield. With the foregoing as a background, it is possible, by making the flow rate of the auxiliary solution to be 0.3–3 cc/min., to provide a coated layer having less uneven portions while keeping a curtain to be stable and thereby to make the product yield maximum.

Figure 9:
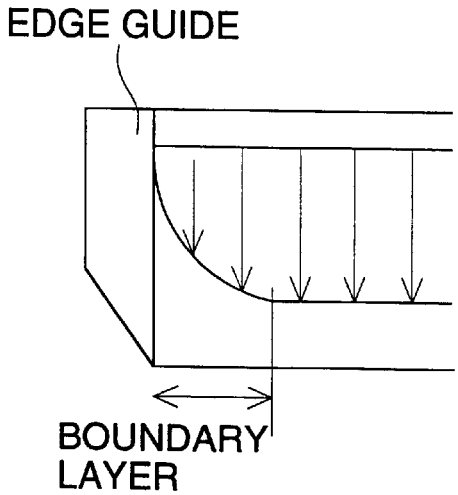
FIG. 9 is a diagram showing a boundary layer of a curtain.

The more an injecting outlet for an auxiliary solution is located at the downstream side of a curtain, the less an effect is less, and when it is located at a lip which is at the upstream side of the curtain, or at the position higher than that, the effect is greater, and the height for supplying which is the same as a coating solution height makes the effect to be maximum. This shows that the sufficient effect can not be obtained by supply a side solution after a boundary layer has been developed as shown in FIG. 9. The boundary layer in this case is a portion where the flow speed distribution in the lateral direction is not uniform. The boundary layer is greatly stretched at the central portion on the curtain, and thereby it is developed greatly, but the boundary layer surely exists even on the slide surface which is before the central portion. The main point for supplying a side solution (auxiliary solution) is how to inhibit the development of a boundary layer, and for that purpose, the side solution with low viscosity is preferable, and supplying at the upstream side is preferable. As far as the flow rate of the auxiliary solution is within a range of not more than 3 cc/min., it hardly happens that the coating solution and the auxiliary solution are mixed and uneven portions are increased.

TABLE 2

| Side solution flow rate (cc/min.) | Solution-injecting outlet (1) | Solution-injecting outlet (2) | Solution-injecting outlet (3) | Solution-injecting outlet (4) |
|---|---|---|---|---|
| 0.0 | D | | | |
| 0.1 | C | C | C | C |
| 0.3 | C | B | B | B |
| 0.5 | C | A | A | A |
| 1.0 | B | A | A | A |
| 2.0 | B | B | A | A |
| 3.0 | C | B | B | B |
| 5.0 | D | C | C | C |
| 10.0 | D | D | D | D |

In the drawing, "a width of an uneven portion is extremely narrow, which is excellent" represents A, "a width of an uneven portion is narrow, which makes it possible to use as a product" represents B, "a width of an uneven portion is wide, which makes it impossible to use as a product" represents C, and "a width of an uneven portion is extremely wide, which makes it impossible to use as a product" represents D.

EXAMPLE 2

Multi-layer curtain coating in which coating solutions of nine kinds were superposed on the slide surface was conducted by the use of a coating apparatus shown in FIG. 3.

Conditions of the coating solutions are as follows.

TABLE 3

| | | Gel % | Viscosity (cp) | Flow rate (cc/min./cm) |
|---|---|---|---|---|
| 1st layer coating solution | gel layer | 7.0 | 70.0 | 0.6 |
| 2nd layer coating solution | gel layer | 7.0 | 70.0 | 0.3 |
| 3rd layer coating solution | gel layer | 7.0 | 70.0 | 0.3 |
| 4th layer coating solution | gel layer | 7.0 | 70.0 | 0.3 |
| 5th layer coating solution | Em layer | 6.0 | 70.0 | 0.5 |
| 6th layer coating solution | gel layer | 7.0 | 70.0 | 0.3 |
| 7th layer coating solution | gel layer | 7.0 | 70.0 | 0.3 |
| 8th layer coating solution | gel layer | 7.0 | 70.0 | 0.3 |
| 9th layer coating solution | Protective layer | 7.0 | 70.0 | 0.3 |

Other coating conditions are as follows.

| | |
|---|---|
| Coating speed (conveyance speed for a support) | 300 m/min. |
| Material of a support | PET |
| Auxiliary solution | 1 wt % gelatin solution |
| Curtain height | 10 cm |

The results were those shown in Table 4.

TABLE 4

| Side solution flow rate (cc/min.) | Solution-injecting outlet (3) | Solution-injecting outlet (5) |
|---|---|---|
| 0.0 | D | |
| 0.3 | B | B |
| 2.0 | A | A |
| 3.0 | B | B |

In the drawing, "a width of an uneven portion is extremely narrow, which is excellent" represents A, "a width of an uneven portion is narrow, which makes it possible to use as a product" represents A, "a width of an uneven portion is wide, which makes it impossible to use as a product" represents C, and "a width of an uneven portion is extremely wide, which makes it impossible to use as a product" represents D.

As is understood from the results of comparison, when a coating apparatus related to the invention is used, it is possible to reduce greatly the occurrence of a thick curtain on the side and unevenness of curtain thickness compared with prior art, resulting in an improvement of production efficiency. Even in the drying step which follows the coating step, load to be applied on a drying means such as a drier is lightened, or the drying step itself is shortened, and degree of freedom for designing coating/drying steps is also increased.

EXAMPLE 3

Figure 4:
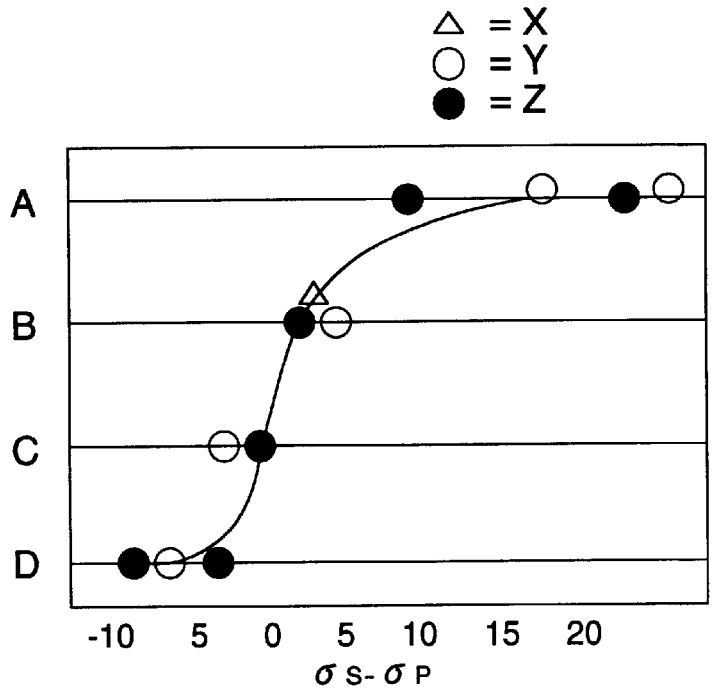
FIG. 4 is a diagram showing a function and an effect of the example of the invention.

Under the same conditions as those in Example 1, coating was conducted with changed surface tension of an auxiliary solution. Flow rates of the auxiliary solution were X: 0.3 cc/min., Y: 0.5 cc/min. and Z: 3 cc/min., and the auxiliary solution was supplied from position (4). The results are shown in FIG. 4. With regard to the symbols in the table, "a width of an uneven portion is extremely narrow, which is excellent" represents A, "a width of an uneven portion is narrow, which makes it possible to use as a product" represents B, "a width of an uneven portion is wide, which makes it impossible to use as a product" represents C, and "a width of an uneven portion is extremely wide, which makes it impossible to use as a product" represents D. The axis of ordinates represents the grade of coating, and the axis of abscissas represents a difference between surface tension of the auxiliary solution and that of the solution to be coated.

As is apparent from the drawing, when surface tension of the auxiliary solution is greater than that of the solution to be coated, excellent coating with less uneven portions can be conducted.

EXAMPLE 4

Figure 5:
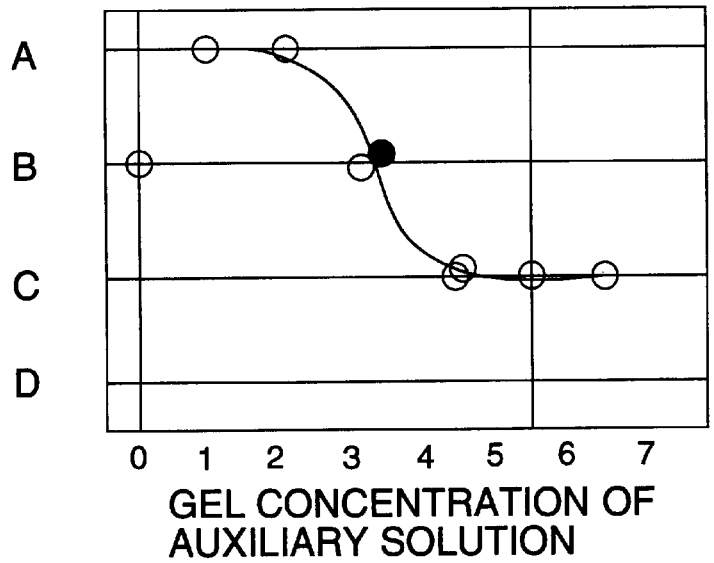
FIG. 5 is a diagram showing a function and an effect of the example of the invention.

Under the same conditions as those in Example 1, coating was conducted with changed gelatin concentration of an auxiliary solution. Flow rates of the auxiliary solution were X: 0.3 cc/min., Y: 0.5 cc/min. and Z: 3 cc/min., and the auxiliary solution was supplied from position (4). The results are shown in FIG. 5. With regard to the symbols in the table, "a width of an uneven portion is extremely narrow, which is excellent" represents A, "a width of an uneven portion is narrow, which makes it possible to use as a product" represents B, "a width of an uneven portion is wide, which makes it impossible to use as a product" represents C, and "a width of an uneven portion is extremely wide, which makes it impossible to use as a product" represents D. The axis of ordinates represents the grade of coating, and the axis of abscissas represents gelatin concentration (percent by weight) of the auxiliary solution.

As is understood from the drawing, when the auxiliary solution has gelatin concentration of not more than 3%, or when it is water (0%), excellent coating with less uneven portions can be conducted.

EXAMPLE 5

Under the same conditions as those in Example 1, coating was conducted with changed viscosity of an auxiliary solution.

The flow rate of the auxiliary solution were 2 cc/min., and the auxiliary solution was supplied from position (3). The results are shown in Table 5. With regard to the symbols in the table, "a width of an uneven portion is extremely narrow, which is excellent" represents A and "a width of an uneven portion is narrow, which makes it possible to use as a product" represents B.

TABLE 5

| | | Example 1 | Example 2 | Example 3 | Example 4 | Example 5 |
|---|---|---|---|---|---|---|
| 1st layer | Emulsion layer viscosity (cp) | 20.0 | 10.0 | 50.0 | 70.0 | 100.0 |
| 2nd layer | Protective layer viscosity (cp) | 20.0 | 10.0 | 10.0 | 70.0 | 100.0 |
| | Results | A | B | B | A | B |

As is apparent from the table, when surface tension of the auxiliary solution is greater than that of the solution to be coated, excellent coating with less uneven portions can be conducted.

The invention makes it possible to form a curtain stably by supplying an appropriate amount of side solution from a solution injecting inlet, and thereby to form a coating layer having less unevenness on the edge portion, which leads to cost reduction and an increase in yield. Further, reduction of thick layers on the edge portion also reduces a load on a process to dry after coating, which leads to advantages of low cost in the viewpoint of manufacturing facilities.

Further, the invention surely reduces unevenness on the edge portion caused by a side solution, because it is possible to increase the flow speed at an edge portion of a coating solution which flows down along the slide surface, by letting the side solution flow down from the solution injecting outlet either at the height which is the same as that of the slit for supplying a coating solution, or at the upstream side.

Further, the curtain can surely be formed when the flow rate of the coating solution ranges from 0.5 cc/min. to 10.0 cc/min.

In addition, stable forming of a curtain and an effect to overcome unevenness on the edge portion, in particular, are remarkable, when the viscosity of a coating solution is in a range of 10–100 cp.

Further, it is possible to obtain a photographic light-sensitive material in which a layer thickness is stable, because an emulsion for a photographic light-sensitive material is supplied as a coating solution and it is coated on a support.

It is further possible to restrict the mixture of the auxiliary solution and the coating solution to the minimum.

It is further possible to form a curtain surely, and to prevent the mixture of the coating solution and the side solution on the edge portion of a curtain.

It is also possible to obtain a photographic light-sensitive material whose layer thickness is stable.

What is claimed is:

1. A coating method for coating a conveyed support with a coating solution suitable for producing a light-sensitive photographic material by letting said coating solution flow down between a first edge guide and a second edge guide so as to form a curtain layer of said coating solution, comprising supplying said coating solution from a slit along a slide surface which is inclined at a predetermined angle to the horizontal, supplying a first auxiliary solution from a first solution injector on a first side plate which is provided on a first edge of said slide surface at a flow rate between 0.3 cc/min and 3.0 cc/min, and supplying a second auxiliary solution from a second solution injector on a second side plate which is provided on a second edge of said slide surface at a flow rate between 0.3 cc/min and 3.0 cc/min, wherein said first edge guide is provided on said first edge, and said second edge guide is provided on said second edge, a value of surface tension of said first auxiliary solution and said second auxiliary solution being not smaller than a minimum value of surface tension of said coating solution, a viscosity of said first auxiliary solution and said second auxiliary solution being smaller than a viscosity of said coating solution.

2. The coating method of claim 1 wherein said first solution injector includes a plurality of first outlets through which said first auxiliary solution is supplied onto said slide surface, and said second solution injector includes a plurality of second outlets through which said second auxiliary solution is supplied onto said slide surface.

3. The coating method of claim 2 wherein said plurality of first outlets is in contact with said slide surface at a height at least as high as that of said slit of said slide surface, and said plurality of second outlets is in contact with said slide surface at a height at least as high as that of said slit of said slide surface.

4. The coating method of claim 1 wherein said first auxiliary solution and said second auxiliary solution are either water or gelatin solution of not more than 3% by weight.

5. The coating method of claim 1 wherein said coating solution is supplied from said slit so that a flow rate of said coating solution is between 0.5 cc/sec/cm and 10.0 cc/sec/cm.

6. The coating method of claim 1 wherein said coating solution is supplied from said slit of said slide surface and has a viscosity between 10 cp and 100 cp.

* * * * *